US007849935B2

(12) United States Patent
Johnson et al.

(10) Patent No.: US 7,849,935 B2
(45) Date of Patent: Dec. 14, 2010

(54) SYSTEM AND METHOD FOR DRILLING WELLBORES

(75) Inventors: Ashley Johnson, Milton (GB); Iain Cooper, Sugar Land, TX (US); Gary Oddie, St Neots (GB); Eric Lavrut, Yokohama (JP); Spyro Kotsonis, Cheltenham (GB); Pierre-Jerome Acquaviva, Clamart (FR)

(73) Assignee: Schlumberger Technology Corporation, Cambridge, MA (US)

( * ) Notice: Subject to any disclaimer, the term of this patent is extended or adjusted under 35 U.S.C. 154(b) by 337 days.

(21) Appl. No.: 11/658,371

(22) PCT Filed: Jun. 14, 2005

(86) PCT No.: PCT/GB2005/002352

§ 371 (c)(1),
(2), (4) Date: Oct. 16, 2008

(87) PCT Pub. No.: WO2006/010877

PCT Pub. Date: Feb. 2, 2006

(65) Prior Publication Data

US 2009/0038854 A1 Feb. 12, 2009

(30) Foreign Application Priority Data

Jul. 24, 2004 (GB) ..... 0416547.8

(51) Int. Cl.
*E21B 21/00* (2006.01)

(52) U.S. Cl. ..... 175/61; 175/324

(58) Field of Classification Search ..... 175/324, 175/61, 62

See application file for complete search history.

(56) References Cited

U.S. PATENT DOCUMENTS

| | | | | | |
|---|---|---|---|---|---|
| 2,765,146 | A * | 10/1956 | Williams, Jr. | ..... | 175/317 |
| 4,341,273 | A * | 7/1982 | Walker et al. | ..... | 175/339 |
| 5,269,384 | A * | 12/1993 | Cherrington | ..... | 175/53 |
| 5,984,011 | A | 11/1999 | Misselbrook et al. | | |
| 2004/0112645 | A1 * | 6/2004 | Eppink et al. | ..... | 175/61 |
| 2005/0098351 | A1 * | 5/2005 | Tennoy et al. | ..... | 175/57 |

FOREIGN PATENT DOCUMENTS

| | | | |
|---|---|---|---|
| WO | 00/75476 | A1 | 12/2000 |
| WO | 2004/011766 | A1 | 2/2004 |

* cited by examiner

*Primary Examiner*—Hoang Dang
(74) *Attorney, Agent, or Firm*—Vincent Loccisano; James McAleenan; Brigid Laffey

(57) ABSTRACT

A system and method are provided for drilling a wellbore. The wellbore is formed with a drilling tool that cuts through a formation. A pumping system removes cuttings from the drilling tool and also transports the cuttings along at least a portion of the wellbore formed behind the drilling tool.

34 Claims, 3 Drawing Sheets

SYSTEM AND METHOD FOR DRILLING WELLBORES

CROSS-REFERENCE TO RELATED APPLICATIONS

This application claims the benefits of priority from:

i) Application Number 0416547.8, entitled "SYSTEM AND METHOD FOR DRILLING WELLBORES," filed in the United Kingdom on Jul. 24, 2004; and ii) Application Number PCT/GB2005/002352, entitled "SYSTEM AND METHOD FOR DRILLING WELLBORES," filed under the PCT on Jun. 14, 2005;

All of which are commonly assigned to assignee of the present invention and hereby incorporated by reference in their entirety.

BACKGROUND

In a variety of subterranean environments, reservoirs hold desirable production fluids, such as petroleum. Wellbores often are drilled into the subterranean environments to facilitate production of the desired fluid. However, wellbores also can be drilled for a variety of other applications related to the fluid production. Such applications include, for example, facilitation of fluid production, fluid injection, sensor placement or other production related functions. The drilling can be oriented in, for example, vertical or deviated, e.g. lateral, directions with the aid of an appropriate drilling tool.

When drilling, cuttings are produced by the action of the drilling tool excavating the borehole. Those cuttings have a larger volume than the original rock mass and therefore need to be removed for excavation of the wellbore. In the conventional drilling of vertical wellbores with drilling equipment deployed on tubing, the cuttings can be removed from the wellbore by circulating drilling mud to transport the cuttings along the wellbore. However, conventional cuttings removal techniques do not work well with, for example, wireline deployed cutting tools, even if a fluid conduit is deployed with the wireline. With wireline deployed systems, the power supply available is limited and there is only a single fluid filled wellbore region behind the drilling tool, thus rendering difficult the circulation of drilling fluid to remove cuttings.

SUMMARY

In general, the present invention provides a system and methodology for drilling wellbores. A drilling tool is deployed downhole to cut through formation material in forming a desired wellbore or wellbores. A pumping system circulates fluid to remove cuttings from the drilling tool and to transport the cuttings away from the drilling tool along the wellbore being formed.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for drilling wellbores used, for example, in the production of desired fluids, e.g. petroleum. The system and method may be used with a variety of downhole drilling tools and equipment. Furthermore, the system and method may be used to form a variety of wellbores in numerous environments and applications, such as wireline services, through-tubing drilling, low-cost reentry drilling, sensor placement, fluid production, fluid injection optimization and other applications. However, the devices and methods of the present invention are not limited to the specific applications that are described herein.

Figure 1:
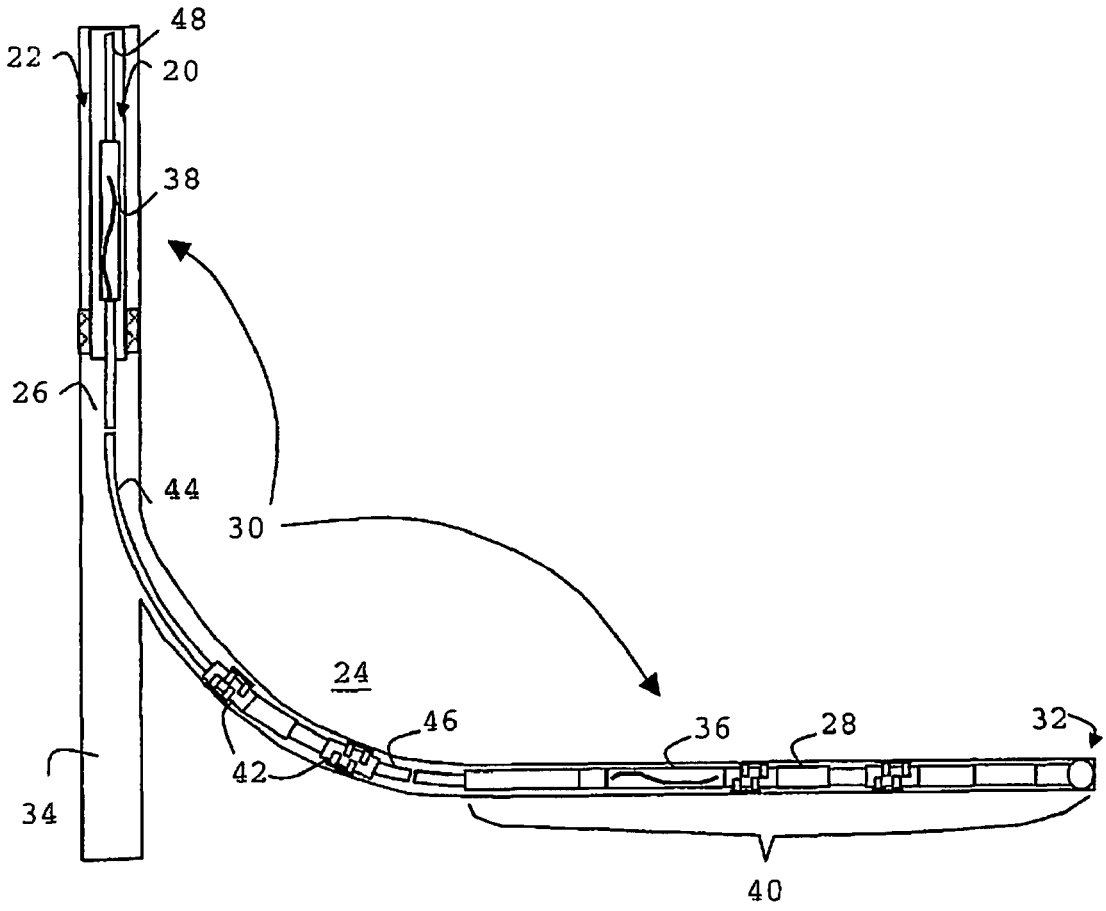
FIG. 1 is an elevation view of a drilling system deployed in a wellbore, according to an embodiment of the present invention.

Referring generally to FIG. 1, a system 20 is illustrated according to an embodiment of the present invention. The system 20 is deployed in a wellbore 22 that has been cut into a formation 24. In this embodiment, wellbore 22 comprises a main wellbore 26 and a deviated or lateral wellbore 28. Lateral wellbore 28 extends from main wellbore 26 and provides a passageway to and from main wellbore 26. As illustrated, main wellbore 26 is generally vertical and lateral wellbore 28 is generally horizontal, however the orientations of the wellbores with respect to each other and with respect to vertical or horizontal orientations may differ from one application to another. For example, lateral wellbore 28 is not necessarily horizontal but may extend at a declined or inclined orientation.

In the embodiment illustrated, system 20 comprises a pumping system 30 that delivers separate, unique fluid flows to a drilling tool 32 and at least a portion of wellbore 22, respectively. The unique fluid flows clear cuttings from drilling tool 32 and transport cuttings along the wellbore to a location where the cuttings do not interfere with the drilling operation or subsequent uses of the wellbore. In the example illustrated, a first-fluid flow clears cuttings from drilling tool 32 and moves them to lateral wellbore 28. A second fluid flow then transports the cuttings along lateral wellbore 28 and deposits them in a downwardly extending section 34 of main wellbore 26.

In this embodiment, the first fluid flow is directed to drilling tool 32 at a higher pressure, lower flow rate relative to the second flow. The higher pressure enables the fluid to clear cuttings from drilling tool 32. The second fluid flow is relatively lower pressure but has a greater flow rate to provide suitable transport of cuttings along lateral wellbore 28.

Referring again to the embodiment of FIG. 1, the illustrated pumping system 30 comprises two separate pumps, a first pump 36 to provide the first fluid flow to drilling tool 32 and a second pump 38 to provide the second fluid flow. By way of example, second pump 38 is located in main wellbore 26, and first pump 36 is located in lateral wellbore 28. However, the pumps may be positioned in a variety of locations depending on the drilling application, e.g., second pump 38 can be located outside main wellbore 26 in, for example, lateral wellbore 28. By way of further example, first pump 36 and drilling tool 32 may be combined in a bottom hole assembly 40.

Although system 20 may utilize several components arranged in a variety of configurations, the illustrated embodiment provides one example. Specifically, second pump 38 is positioned in main wellbore 26 and coupled to a rear tractor 42 by a fluid conduit 44. Rear tractor 42 is coupled to bottom hole assembly 40 by a transition pipe 46. Second pump 38 draws fluid from main wellbore 26 and pumps the fluid through fluid conduit 44, through rear tractor 42, through transition pipe 46 and typically through at least a portion of bottom hole assembly 40. As will be explained more fully below, the fluid is then expelled outwardly into the lateral wellbore surrounding bottom hole assembly 40. The expelled fluid flows back along lateral wellbore 28 in sufficient volume to transport the cuttings along lateral wellbore 28 to a collection point, such as downwardly extending section 34.

As illustrated, drilling tool 32 and overall system 20 are deployed on a wireline 48. Power may be supplied to system 20 through wireline 48. However, the power supplied through a wireline often is limited to less than 10 kilowatts. Thus, the drilling system components, such as drilling tool 32, pump 36 and pump 38 are designed to operate collectively within the power limitations. One example of a suitable wireline 48 is a quad cable that handles approximately nine kilowatts. In many system designs, the use of separate pumps for clearing cuttings from drilling tool 32 and for transporting cuttings along lateral wellbore 28 can make relatively efficient use of available power.

Figure 2:
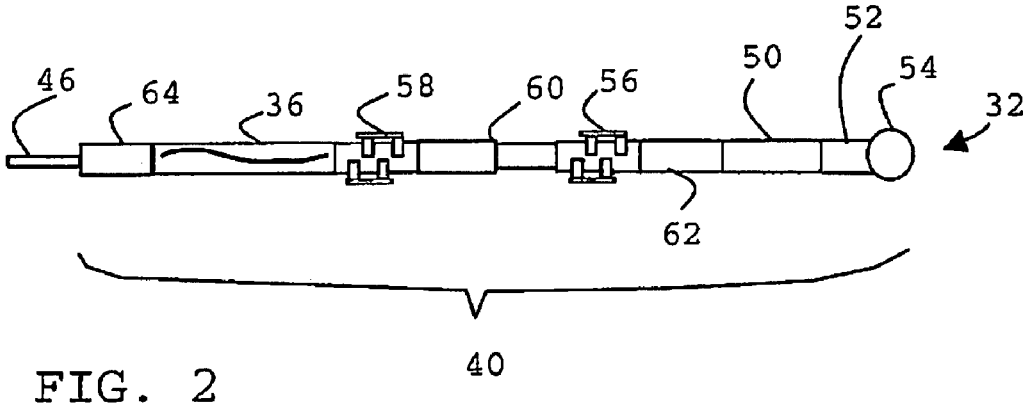
FIG. 2 is an elevation view of an embodiment of a bottom hole assembly that can be used with the system illustrated in FIG. 1.

A variety of bottom hole assemblies can be used in the illustrated system depending on the specific application, environment and design parameters. An embodiment of bottom hole assembly 40 is illustrated in FIG. 2. In this example, bottom hole assembly 40 comprises drilling tool 32 having a drilling motor 50, a bearing housing 52 and a drilling bit 54. The bottom hole assembly 40 also comprises first pump 36 which can be, for example, a progressing cavity pump, a centrifugal pump or a mixed flow pump. Between pump 36 and drilling tool 32, bottom hole assembly 40 comprises at least one anchor, such as lower anchor 56 and upper anchor 58. Lower anchor 56 and upper anchor 58 may be separated by a WOB piston 60. Additionally, the assembly may comprise an orientor 62 for orienting the drilling via drilling bit 54. An electronics chassis 64 may be located generally adjacent pump 36 and is designed to control the various electronic inputs to components of bottom hole assembly 40.

Figure 3:
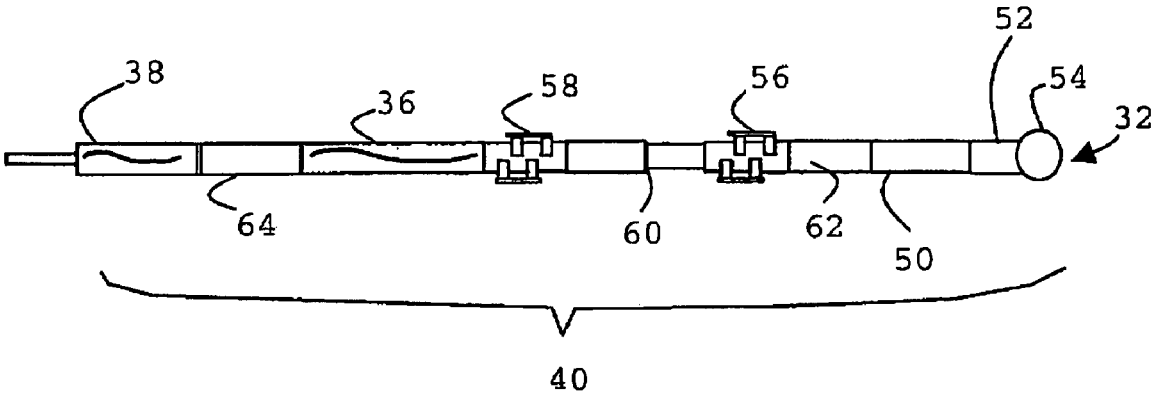
FIG. 3 is an alternate embodiment of the drilling system illustrated in FIG. 1.

In an alternate embodiment, illustrated in FIG. 3, second pump 38, e.g. a progressing cavity pump, is included in bottom hole assembly 40. This type of configuration also can be designed to reverse circulate the cuttings such that the transport fluid is drawn down an annulus of the wellbore and then pumped back, along with the cuttings, through the central tubing to main wellbore 26. Thus, various pumps and pumping systems can be used in unique selected locations within the wellbore.

Regardless of the specific configuration of the pumping system 30, the use of separate fluid flows to clean cutting bit 54 of drilling tool 32 and to transport cuttings along the wellbore provides a more efficient system amenable to deployment with a wireline. In the system illustrated, for example, first pump 36 is used to provide a fluid flow of relatively high pressure but low volume flow rate for efficient cleaning of drilling bit 54. However, second pump 38 provides a second fluid flow at a higher volume flow rate but at a lower pressure, relative to first pump 36. The second flow rate is sufficient to move cuttings along the wellbore, e.g. lateral wellbore 28. The dual pumps provide greater power efficiency and an ability to remove cuttings with a wireline deployed system used for drilling lateral wellbores. The configuration enables the efficient cleaning of cuttings from the drilling bit 54 as well as the transport of those cuttings from the lateral wellbore 28.

Figure 4:
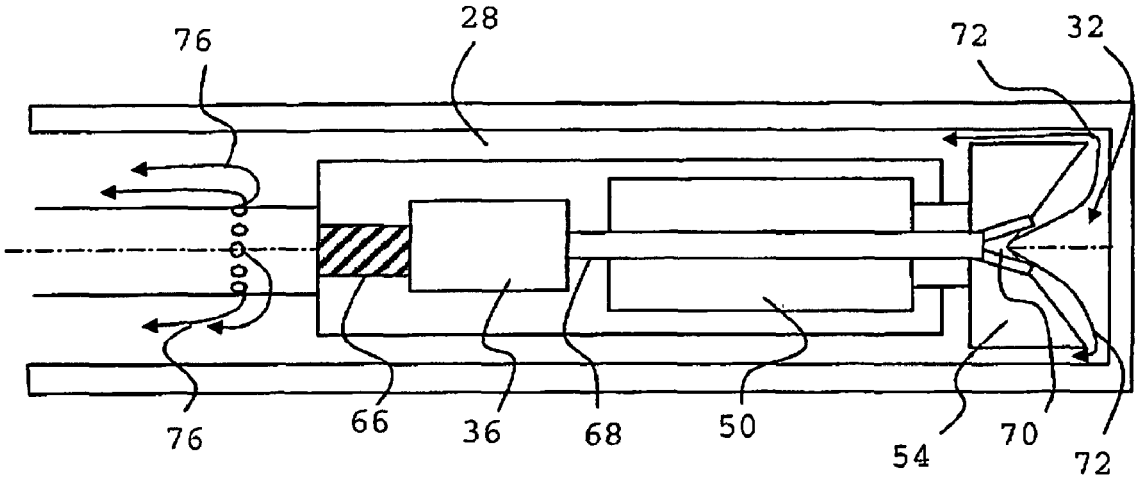
FIG. 4 is a schematic illustration of an embodiment of a drilling tool that can be used with the system illustrated in FIG. 1.

To avoid problems in the transfer of cuttings] between the bottom hole assembly 40 and the main fluid transport flow through lateral wellbore 28, a filter 66 may be used to prevent recirculation of cuttings, as illustrated in FIG. 4. In this embodiment, first pump 36 draws fluid through filter 66 and discharges the fluid into a passageway 68. Passageway 68 conducts the fluid through drilling motor 50 and drilling bit 54 until the fluid is forced outwardly through one or more bit nozzles 70. The outward flow of fluid through bit nozzles 70 washes cuttings away from drilling bit 54 and circulates the cuttings back through lateral wellbore 28 along the exterior of drilling motor 50 and pump 36, as illustrated by arrows 72.

As the cuttings are cleared from drilling bit 54 and moved back along the lateral wellbore 28, the cuttings are drawn into the main fluid transport flow. In this embodiment, the fluid transport flow, generated by second pump 38, exits bottom hole assembly 40 through bypass ports 74. The cuttings from drilling bit 54 are drawn into this transport stream, as represented by arrows 76, and transported back along lateral wellbore 28. As described previously, the cuttings can be transported to downwardly extending section 34 of main wellbore 26 or to some other collection location.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for drilling a lateral wellbore, comprising:
a wireline;
a drilling tool deployable into a lateral wellbore by the wireline, the drilling tool having a drilling bit;
a first pump to move fluid to the drilling bit for clearing cuttings from the drilling bit; and
a second pump to circulate fluid through the lateral wellbore to transport cuttings from the lateral wellbore.

2. The system as recited in claim 1, wherein the drilling tool and the first pump are located in a bottom hole assembly.

3. The system as recited in claim 2, wherein the second pump is located in a main wellbore from which the lateral wellbore extends.

4. The system as recited in claim 1, wherein the second pump operates at a higher flow rate than the first pump.

5. The system as recited in claim 1, wherein the first pump operates at a higher pressure than the second pump.

6. The system as recited in claim 1, wherein the first pump and the second pump are located in a bottom hole assembly.

7. The system as recited in claim 1, wherein the wireline comprises a quad cable.

8. The system as recited in claim 7, wherein the quad cable is able to supply up to nine kilowatts of power downhole.

9. The system as recited in claim 1, wherein the first pump draws a wellbore fluid through a filter before moving the wellbore fluid through the drilling bit.

10. A method of a drilling a lateral wellbore, comprising:
drilling a lateral wellbore with a drilling tool deployed on a wireline;

clearing cuttings from the drilling tool with a fluid flow from a first pump; and transporting the cuttings from the lateral wellbore with a fluid pumped by a second pump.

11. The method as recited in claim 10, further comprising locating the second pump in a main wellbore and the first pump in the lateral wellbore.

12. The method as recited in claim 10, wherein drilling comprises deploying the drilling tool with a quad cable.

13. The method as recited in claim 10, wherein transporting comprises transporting the cuttings to a main wellbore from which the lateral wellbore extends.

14. The method as recited in claim 10, wherein clearing cuttings comprises applying a higher pressure with the first pump than with the second pump.

15. The method as recited in claim 10, wherein transporting comprises pumping fluid at a greater flow with the second pump than with the first pump.

16. The method as recited in claim 10, further comprising locating the drilling tool and the first pump in a bottom hole assembly.

17. The method as recited in claim 10, further comprising using less than 10 kilowatts for powering the drilling tool, the first pump and the second pump.

18. A method of drilling a wellbore, comprising:

drilling a lateral wellbore with a drilling tool deployed on a wireline;

directing a first fluid flow through the drilling tool to clear cuttings from the drilling tool; and providing a second fluid flow at a higher flow rate and lower pressure, relative to the first fluid flow, to clear cuttings from the lateral wellbore.

19. The method as recited in claim 18, wherein directing comprises pumping fluid with a first pump.

20. The method as recited in claim 19, wherein providing comprises pumping fluid with a second pump.

21. The method as recited in claim 20, further comprising locating the drilling tool and the first pump in a bottom hole assembly.

22. The method as recited in claim 21, further comprising deploying the second pump in a vertical wellbore from which the lateral wellbore extends.

23. The method as recited in claim 20, further comprising locating the drilling tool, the first pump and the second pump in a bottom hole assembly.

24. The method as recited in claim 18, further comprising filtering the first fluid flow prior to clearing the cuttings from the drilling tool.

25. The method as recited in claim 18, wherein drilling comprises utilizing a plurality of anchors in the lateral wellbore.

26. A system for drilling a wellbore, comprising:

a wireline;

a drilling tool deployed on the wireline; and a pumping system located downhole, the pumping system providing separate fluid flows for clearing cuttings from the drilling tool and for transporting cuttings along at least a portion of a wellbore wherein the pumping system comprises a first pump and a second pump to provide the separate fluid flows for clearing cuttings and transporting cuttings, respectively.

27. The system as recited in claim 26, wherein the drilling tool comprises a drill bit having bit nozzles through which fluid flows to remove cuttings.

28. The system as recited in claim 26, wherein cuttings are cleared from the drilling tool while the drilling tool is disposed in a lateral wellbore.

29. The system as recited in claim 26, wherein the first pump provides a higher pressure fluid flow than the second pump.

30. The system as recited in claim 26, wherein the first pump is disposed in a lateral wellbore and the second pump is disposed in a main wellbore from which the lateral wellbore extends.

31. A system for drilling a wellbore, comprising:

means for drilling a lateral wellbore with a drilling tool deployed on a wireline;

means for directing a first fluid flow through the drilling tool to clear cuttings from the drilling tool; and means for providing a second fluid flow at a higher flow rate and lower pressure, relative to the first fluid flow, to clear cuttings from the lateral wellbore.

32. The system as recited in claim 31, wherein the means for drilling comprises a bottom hole assembly having a drilling tool.

33. The system as recited in claim 32, wherein the means for directing comprises a first pump located in the bottom hole assembly.

34. The system as recited in claim 33, wherein the means for transporting comprises a second pump.

* * * * *